US006494673B2

(12) United States Patent
Choy et al.

(10) Patent No.: US 6,494,673 B2
(45) Date of Patent: Dec. 17, 2002

(54) TURBINE ENGINE

(75) Inventors: Dominic K L Choy, Cammeray (AU); Stuart Daevys, Mount White (AU); Amir S Khoshkbijary, Neutral Bay (AU)

(73) Assignee: ECO-Turbo Pty Limited ACN, Sydney (AU)

( * ) Notice: Subject to any disclaimer, the term of this patent is extended or adjusted under 35 U.S.C. 154(b) by 0 days.

(21) Appl. No.: 09/863,805

(22) Filed: May 24, 2001

(65) Prior Publication Data

US 2002/0034440 A1 Mar. 21, 2002

(30) Foreign Application Priority Data

Sep. 18, 2000 (AU) ..... PR0217

(51) Int. Cl.[7] ..... F01D 1/12
(52) U.S. Cl. ..... 415/55.1; 415/57.2; 415/57.3
(58) Field of Search ..... 415/54.1, 55.1–55.6, 415/57.2–57.4

(56) References Cited

U.S. PATENT DOCUMENTS 3,854,841 A 12/1974 Eskeli
3,877,835 A 4/1975 Siptrott
5,413,457 A 5/1995 Tuckey

FOREIGN PATENT DOCUMENTS

AU 164203 7/1955
AU A-35668/93 5/1993

*Primary Examiner*—Edward K. Look
*Assistant Examiner*—Dwayne J. White
(74) *Attorney, Agent, or Firm*—Larson & Taylor PLC

(57) ABSTRACT

The present invention relates generally to a turbine engine (10) comprising a housing (12) in which a rotor (14) is rotatably mounted. The housing (12) of the turbine engine (10) is of a split casing construction including a center casing (24) sandwiched between a pair of outer casings, namely an inlet outer casing (26) and an outlet outer casing (28). The rotor 14 is shaped circular in profile and includes three working surfaces generally defined by a peripheral surface (32) and a pair of opposing sides surfaces (34) and (36), respectively. The peripheral surface (32) of the rotor (14) which acts as a fist stage of the turbine (10) includes a plurality of circumferentially spaced and generally axially directed ribs in the form of a series of arcuate flutes such as (38). The rotor (14) also includes a plurality of angularly spaced and radially extending rotor blades such as (40) which in transverse cross-section are aerofoil shaped with at least a portion of the concave or generally flat and convex surfaces of each of the blades (40) defining two further working surfaces of the rotor (14).

26 Claims, 10 Drawing Sheets

TURBINE ENGINE

FIELD OF THE INVENTION

The present invention relates generally to a turbine engine and relates particularly, though not exclusively, to a rotor of a turbine engine which is driven by a working fluid.

SUMMARY OF THE INVENTION

According to one aspect of the present invention there is provided a rotor of a turbine engine, said rotor being shaped substantially circular in profile and including three working surfaces generally defined by a peripheral and a pair of adjacent or opposing surfaces, respectively, of the rotor whereby in operation a working fluid introduced into the turbine engine acts consecutively on the peripheral and thereafter the pair of adjacent or opposing surfaces of the rotor in three respective stages of the turbine to effect rotation of the rotor.

According to another aspect of the invention there is provided a turbine engine comprising a housing within which a rotor is rotatably mounted, said rotor being shaped substantially circular in profile and including three working surfaces generally defined by a peripheral and a pair of adjacent or opposing surfaces, respectively, of the rotor whereby in operation a working fluid introduced into the housing of the engine acts consecutively on the peripheral and thereafter the pair of adjacent or opposing surfaces of the rotor in three respective stages of the turbine to effect rotation of the rotor.

Preferably the peripheral surface of the rotor includes a plurality of circumferentially spaced and generally axially directed ribs. More preferably the plurality of ribs are in the form of a series of arcuate flutes each being formed in the periphery of the rotor wherein the working fluid introduced tangentially onto the peripheral surface of the rotor is in a first stage of the turbine directed axially toward one of the pair of opposing side surfaces.

Typically the pair of adjacent surfaces of the rotor are generally defined by a plurality of angularly spaced and radially extending rotor blades. More typically the blades are shaped in cross-section and/or angularly oriented relative to an axis of the rotor whereby in operation the working fluid acts on adjacent and/or opposing surfaces of the rotor blades in a second and third stage of the turbine engine. Alternatively the pair of opposing surfaces of the rotor each include a series of angularly spaced and radially extending other ribs formed on respective opposing faces of the rotor. In this embodiment the other ribs are formed as other flutes in a swirl configuration in the pair of opposing faces of the rotor.

Preferably the housing is constructed as a split casing. More preferably the housing includes a centre casing sandwiched between a pair of outer casings. In this example the rotor is substantially enclosed circumferentially by the centre casing which includes one or more tangentially directed inlets for the working fluid.

Typically the pair of outer casings include an inlet outer casing and an outlet outer casing, respectively. More typically the inlet outer casing includes an annular groove being adapted to receive the working fluid from the first stage and redirect said fluid to the second stage. Even more typically, the outlet outer casing includes an annular recess being adapted to receive the working fluid from the second stage and redirect said fluid to the third stage. In this embodiment the annular recess includes a series of further flutes being angularly spaced and directed generally radially inward so as to promote a corresponding "flow" of the working fluid.

Preferably the housing further includes an exhaust casing mounted to the outlet outer casing and adapted to axially discharge the working fluid from the turbine engine. More preferably the exhaust casing includes an exhaust nozzle and internally is shaped in the general form of a conical frustum having its large diameter end disposed adjacent the rotor. In this example the exhaust nozzle includes a baffle plate which is designed to control the pressure of the working fluid at the third stage of the turbine.

Typically the turbine engine is adapted to operatively couple to an alternator for power generation. More typically the turbine engine is operatively coupled to a waste heat source which exchanges heat with the working fluid prior to its introduction into the turbine. Generally the working fluid is a working gas such as LPG or a refrigerant gas.

BRIEF DESCRIPTION OF THE DRAWINGS

In order to achieve a better understanding of the nature of the present invention a preferred embodiment of a turbine engine will now be described, by way of example only, with reference to the accompanying drawings in which.

DETAILED DESCRIPTION OF THE PREFERRED EMBODIMENTS

Figure 1:
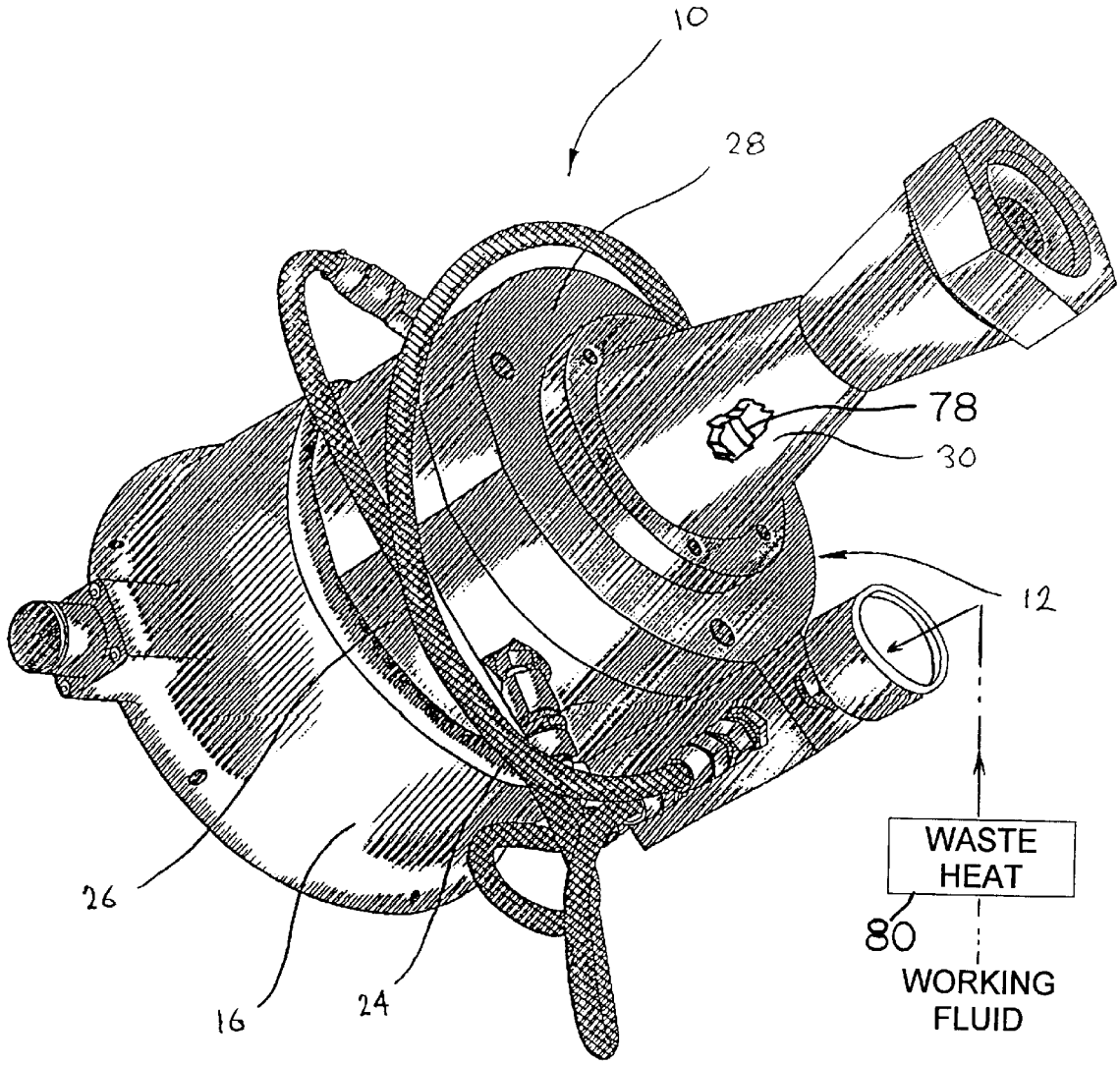
FIG. 1 is a perspective view of a turbine engine operatively mounted to an alternator.

As shown in FIG. 1 there is a turbine engine 10 comprising a housing shown generally as 12 in which a rotor 14 (see FIGS. 2 and 3) is rotatably mounted. In this example the turbine engine is operatively coupled via a shaft (not shown) and mounted to an alternator 16 of a conventional construction for power generation. The turbine engine 10 is designed to be driven by a working fluid which is preferably a working gas such as LPG or a refrigerant gas.

The housing 12 of this embodiment of the turbine engine 10 is of a split casing construction including a centre casing 24 sandwiched between a pair of outer casings, namely an inlet outer casing 26 and an outlet outer casing 28. The housing 12 also includes an exhaust casing 30 mounted to the outlet outer casing 28 and arranged to axially discharge the working gas from the turbine engine 10.

Figure 2:
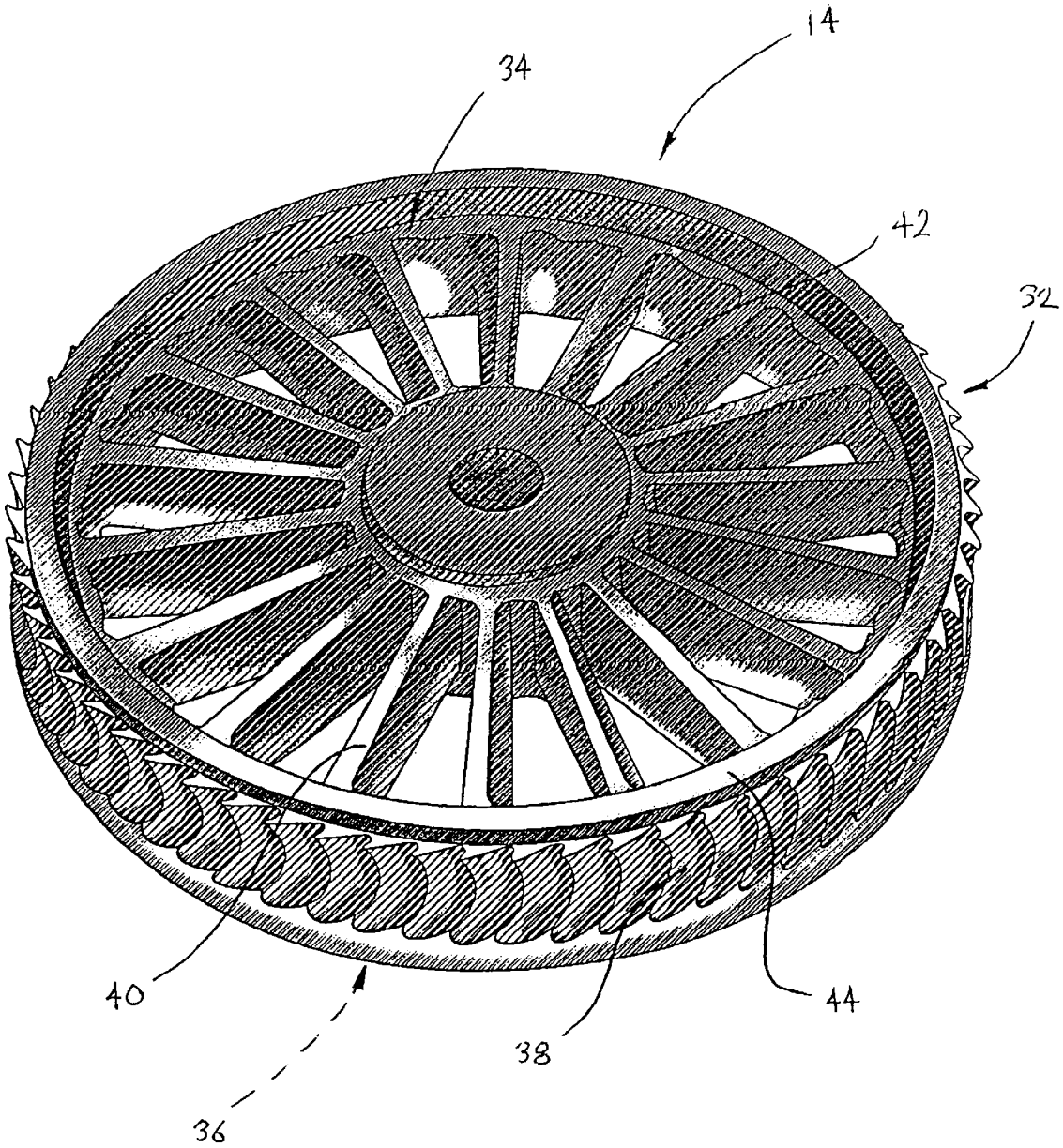
FIG. 2 is a perspective view of a rotor of the turbine engine of FIG. 1 taken from an inlet side of the rotor.
Figure 3:
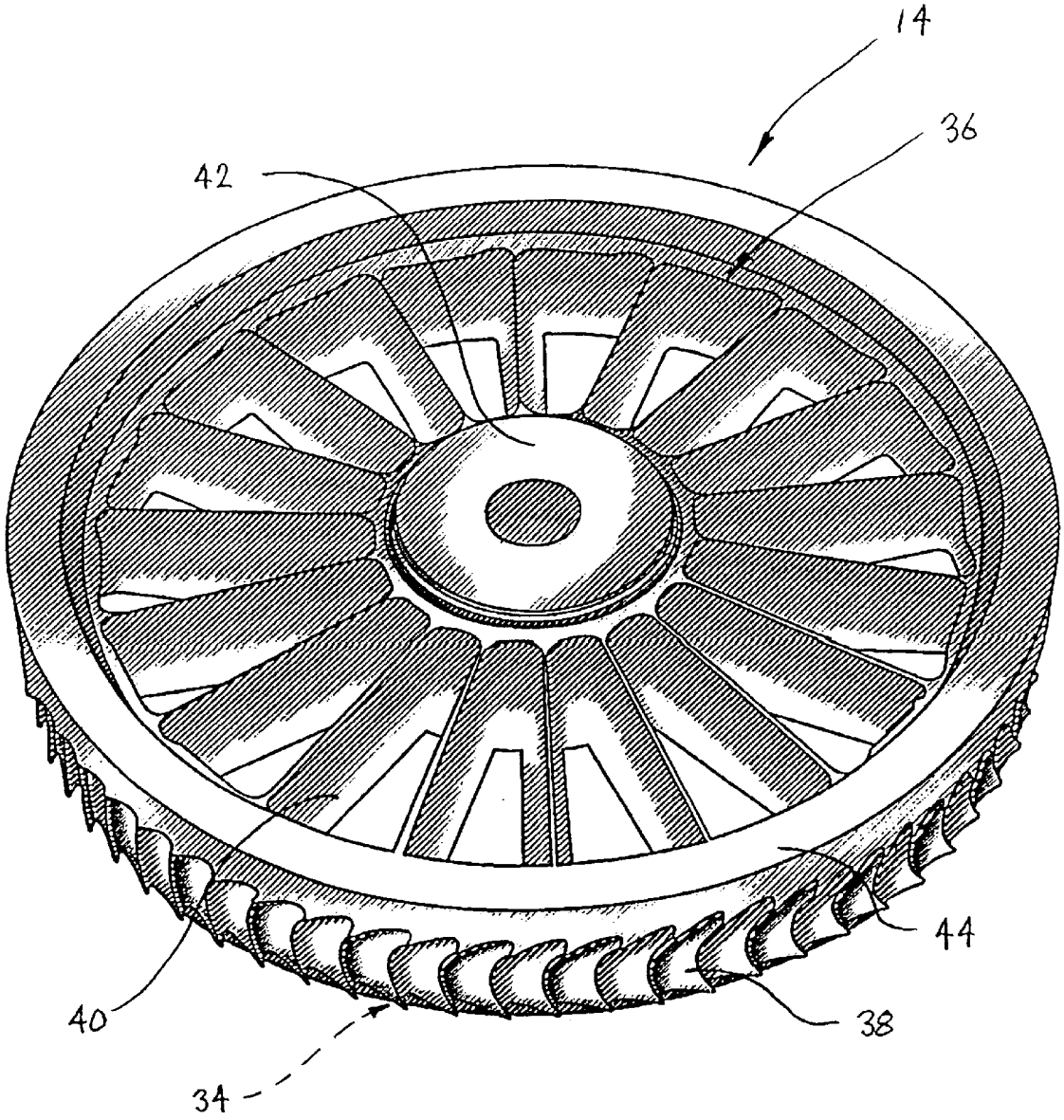
FIG. 3 is a perspective view of the rotor of FIG. 2 taken from its outlet side.

As best shown in FIGS. 2 and 3 the rotor 14 of this embodiment is shaped circular in profile and includes three (3) working surfaces generally defined by a peripheral surface 32 and a pair of opposing side surfaces 34 and 36, respectively. The peripheral surface 32 of the rotor 14 which acts as a first stage of the turbine 10 includes a plurality of circumferentially spaced and generally axially directed ribs in the form of a series of arcuate flutes such as 38. The arcuate flutes 38 are formed in the peripheral surface 32 of the rotor 14 wherein the working fluid which is introduced tangentially onto said surface 32 is in the first stage of the turbine 10 directed axially toward an inlet side of the rotor 14 which is depicted as facing upward in FIG. 2. The flutes 38 are configured so that together they represent a repeating wave form which is directed away from the direction of rotation of the rotor 14.

The rotor 14 also includes a plurality of angularly spaced and radially extending rotor blades such as 40. The rotor blades 40 are shaped substantially identical to one another and radially extend from a central hub 42 to a peripheral rim 44. The blades such as 40 are in transverse cross-section aerofoil shaped having opposing concave or generally flat and convex surfaces. The aerofoiled blades such as 40 also include a relatively blunt leading edge and a relatively sharp trailing edge disposed on the inlet and the outlet sides, respectively, of the rotor 14. In this example at least a portion of the concave or generally flat and convex surfaces of each of the blades 40 defines two further working surfaces of the rotor 14. The working gas introduced into the turbine engine 10 thus acts consecutively on the three working surfaces of the rotor 14 in the three respective stages of the turbine 10 to effect rotation of the rotor 14.

Advantageously, the rim 44 of the rotor 14 provides a shroud for the ends of the rotor blades 40 which creates a boundary layer "seal". The rim 44 on its inner circumferential surface is shaped to enhance contact of the working gas which under centrifugal force is forced radially outward along the blades 40. Importantly, the blades 40 are each configured wherein the working gas expelled from the first stage is driven across the blades 40 wherein a pressure differential is created between the concave or generally flat and the convex surfaces of the blades 40. This pressure differential, in a manner similar to the lift of a wing or sail, promotes rotation of the rotor 14. It will be apparent that the rotation induced by this pressure differential is in the same direction as that promoted by the gas tangentially striking the flutes 38 in the first stage.

Figure 4:
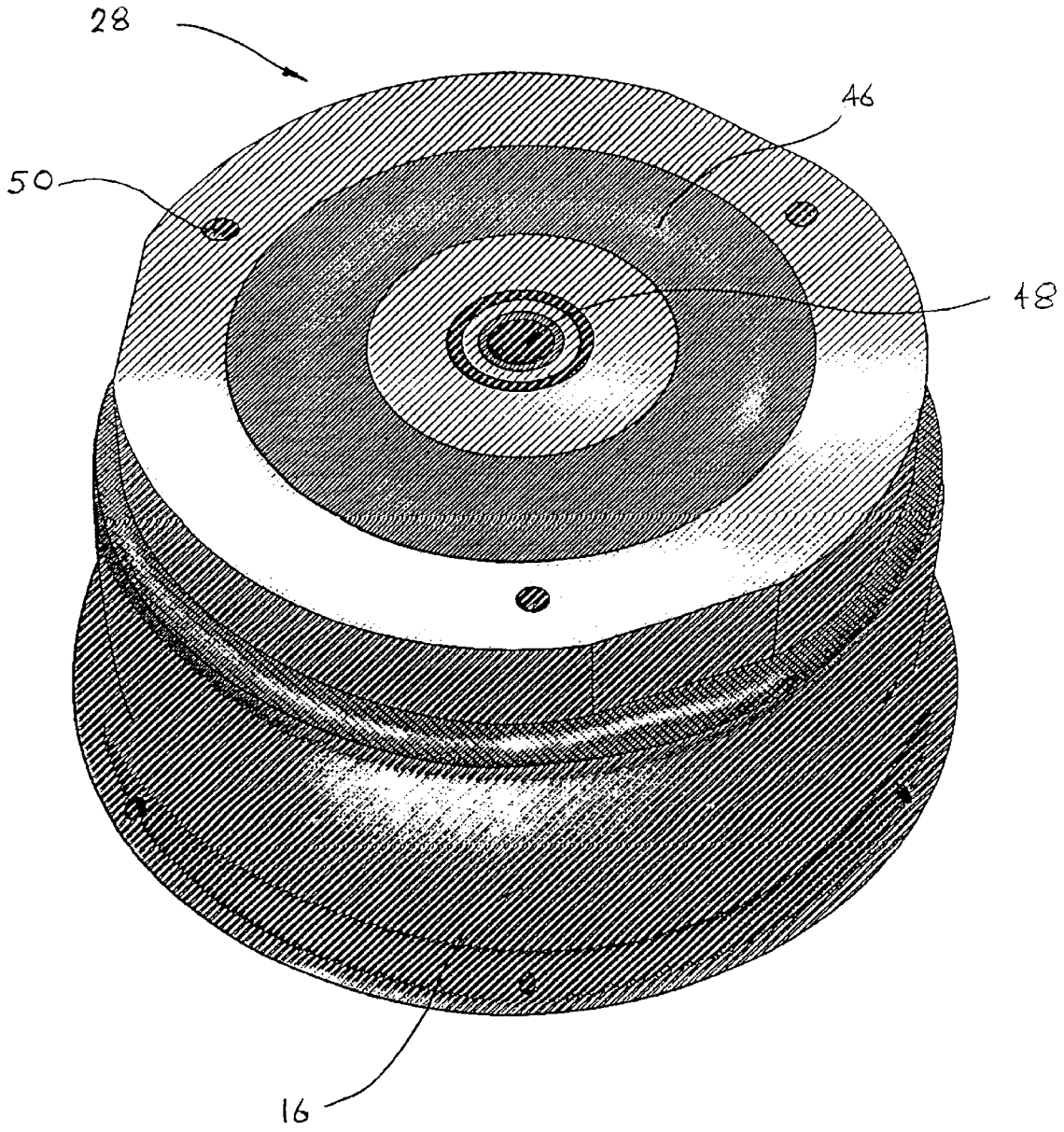
FIG. 4 is a perspective view of an inlet outer casing of the turbine engine of FIG. 1 together with the alternator.
Figure 8:
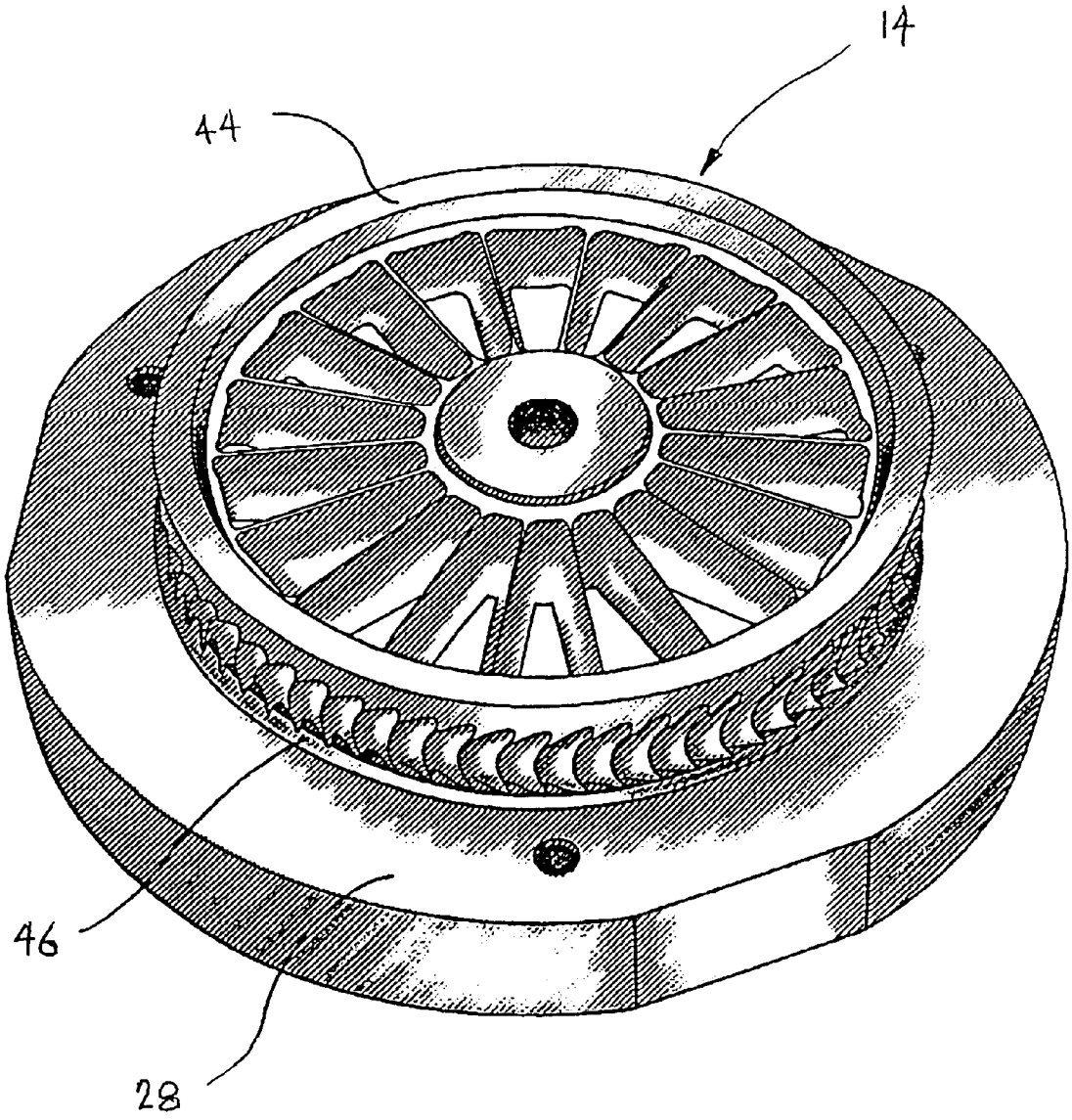
FIG. 8 is a perspective view of the rotor positioned on the inlet outer casing of the turbine of FIG. 1.

FIG. 4 depicts the inlet outer casing 28 mounted to the alternator 16 which itself does not form part of the invention. The inlet outer casing 28 is in the form of a solid disc having an annular groove 46 formed in one of its faces. The annular groove 46 is in radial cross-section shaped generally semicircular. As best shown in FIG. 8 the outer circumference of the annular groove 46 is slightly greater than the outer circumference of the rim 44 of the rotor 14. Thus, the annular groove 46 receives working gas which "flows" axially from the first stage of the rotor 14. The annular groove 46 being semicircular in its radial cross-section then deflects the working gas inwardly of the turbine 10 toward the second stage of the rotor 14. The inlet outer casing. 28 also includes an axial opening 48 through which the shaft of the rotor 14 is journalled. Otherwise, the inlet outer casing 28 includes three (3) circumferentially space mounting holes such as 50.

Figure 5:
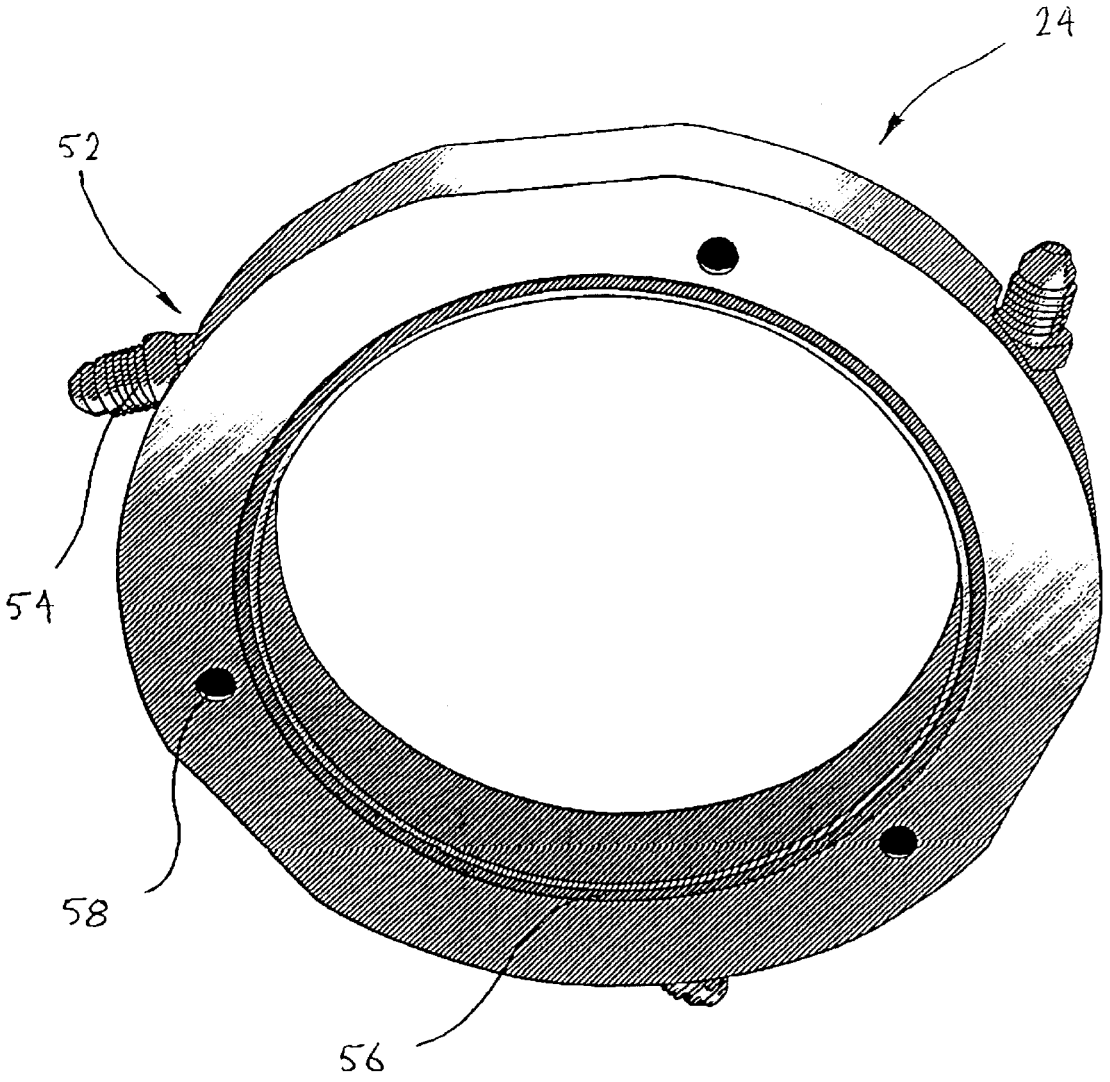
FIG. 5 is a perspective view of a centre casing of the turbine of FIG. 1.

FIG. 5 shows the centre casing 24 which is ring-shaped having its internal diameter dimensioned to provide a clearance fit for the rotor 14. The centre casing 24 includes three (3) inlet ports such as 52. equally angularly spaced about the centre casing 24 and directed radially inward of the centre casing 24 so that the working gas strikes the flutes such as 38 of the rotor 14. In this example the inlet ports such as 52, which are represented by the corresponding inlet nipple 54, generally form a tangent to the rotor 14 about 10 mm inward of its outer circumferential surface. The centre casing 24 includes an annular recess such as 56 on each of its opposing faces, the recess such as 56 providing seating for an O-ring type seal (not shown). The centre casing 24 includes further mounting holes such as 58 aligned with the mounting holes 50 of the inlet outer casing 28.

Figure 6:
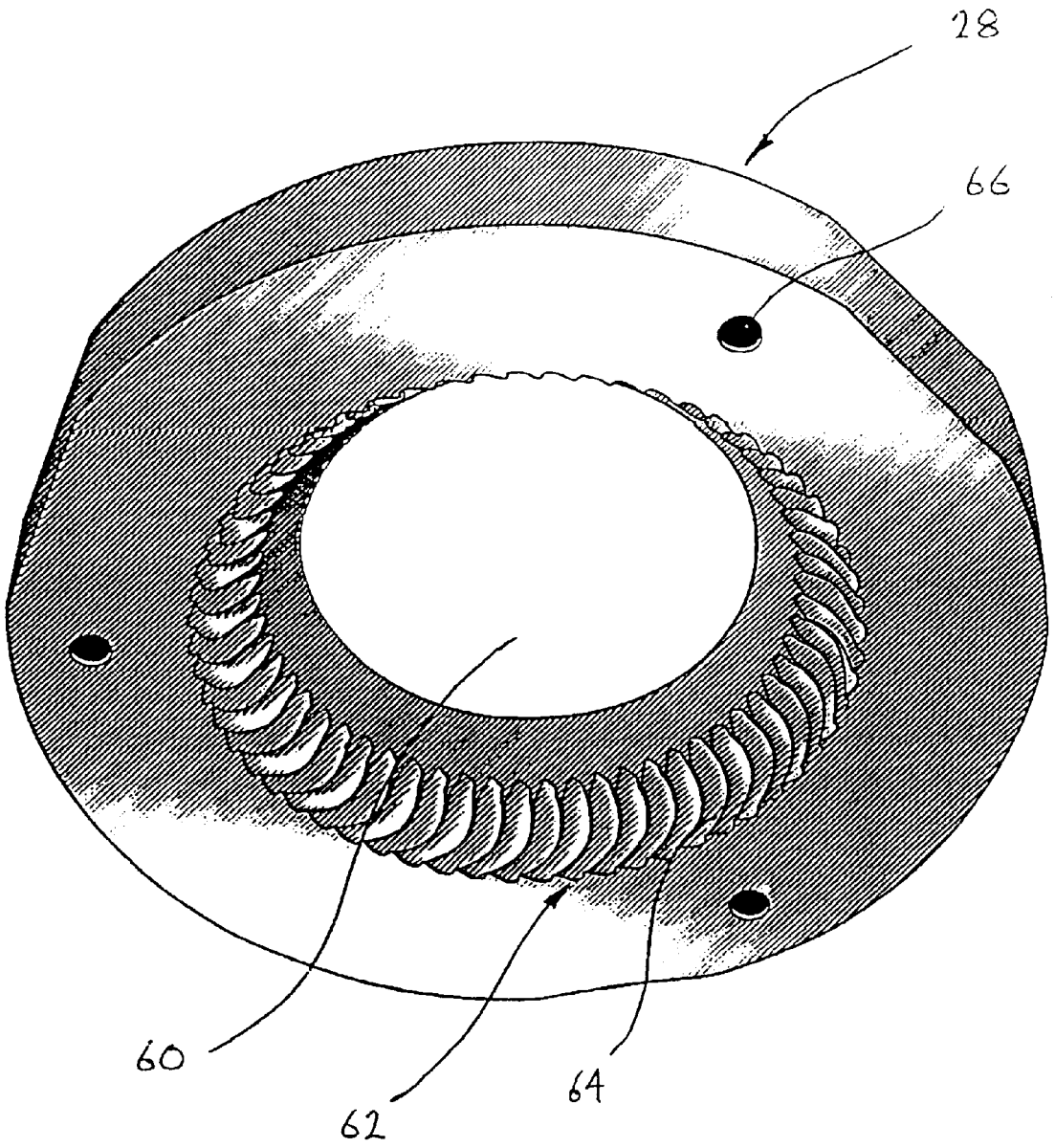
FIG. 6 is a perspective view of an outlet outer casing of the turbine of FIG. 1.

FIG. 6 depicts the outlet outer casing 28 of the housing 12. The outlet outer casing 28 is also ring-shaped and of similar dimensions to the centre casing 24 except that its central opening 60 is of a smaller dimension and is tapered inward away from the rotor 14. The outlet outer casing 28 also includes an annular groove or bevel 62 formed in the innermost edge of the central opening 60. The annular bevel 62 includes a series of further arcuate flutes such as 64 which are angularly spaced and directed generally radially inward of the housing 12. These further flutes 64 serve to promote a flow of the working gas against the concave or generally flat surface of the blades such as 40 at their trailing edge and further promotes rotation of the rotor 14. It is understood that as the working gas is expelled onto the other working surface of the rotor 14 in the third stage a low pressure region is induced in the area of the hub 42. This low pressure region draws the working gas from the perimeter of the rotor 14 into a central region of the outlet outer casing 28.

Figure 7:
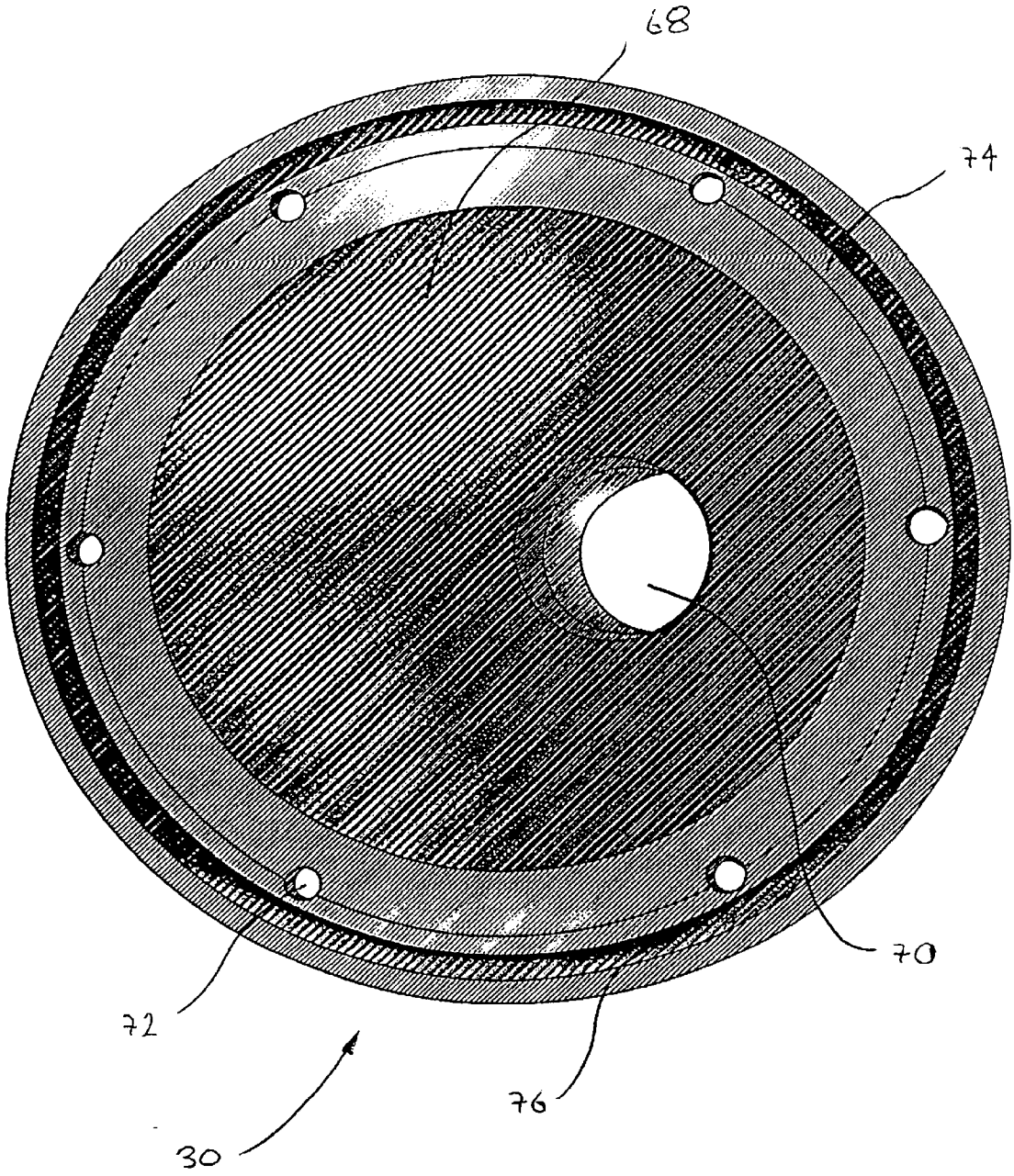
FIG. 7 is a perspective view of an exhaust casing of the turbine of FIG. 1.

FIG. 7 shows the exhaust casing 30 of the housing 12 of the turbine motor 10. The exhaust casing 30 of this embodiment is mounted to the outlet outer casing 28 and includes an exhaust nozzle which internally is shaped in the general form of a conical frustum. The exhaust nozzle 68 is formed continuous with an outlet conduit 70 which is slightly enlarged at its outlet. The exhaust nozzle 68 at its large diameter end is mounted to the outlet outer casing 28 via a series of circumferentially spaced other mounting holes such as 72 which are included in a flanged portion 74 of the exhaust nozzle 68. The flanged portion 74 includes a further annular recess 76 in which an O-ring type seal can be seated. Although only partially shown schematically in the broken away section in FIG. 1, the exhaust nozzle 68 may include a baffle plate 78 which is designed to control the pressure of the working fluid at the third stage of the turbine engine 10.

In order to facilitate a further understanding of the present invention, operation of the turbine engine 10 described will now be outlined according to the following general steps:

(i) a working gas is tangentially directed through the centre casing 24 of the housing 12;

(ii) the working gas acts against the flutes such as 38 of the rotor 14 in the first stage of the turbine 10;

(iii) the working gas is directed axially away from the rotor 14 and into the annular groove 46 of the inlet outer casing 28;

(iv) the annular groove 46 is configured to deflect the working gas inwardly of the turbine 10 wherein it strikes the turbine blades such as 40 in a second stage of the turbine 10;

(v) the working gas under centrifugal force is forced radially outwardly from the rotor 14 and impinges on the further flute 64 of the annular bevel 62;

(vi) the working gas is drawn into a low pressure region of the outlet outer casing 28 and acts on the blades such as 40 in a third stage of the turbine 10; and (vii) the working gas is expelled from the outlet outer casing 28 via the exhaust casing 30.

Figure 9:
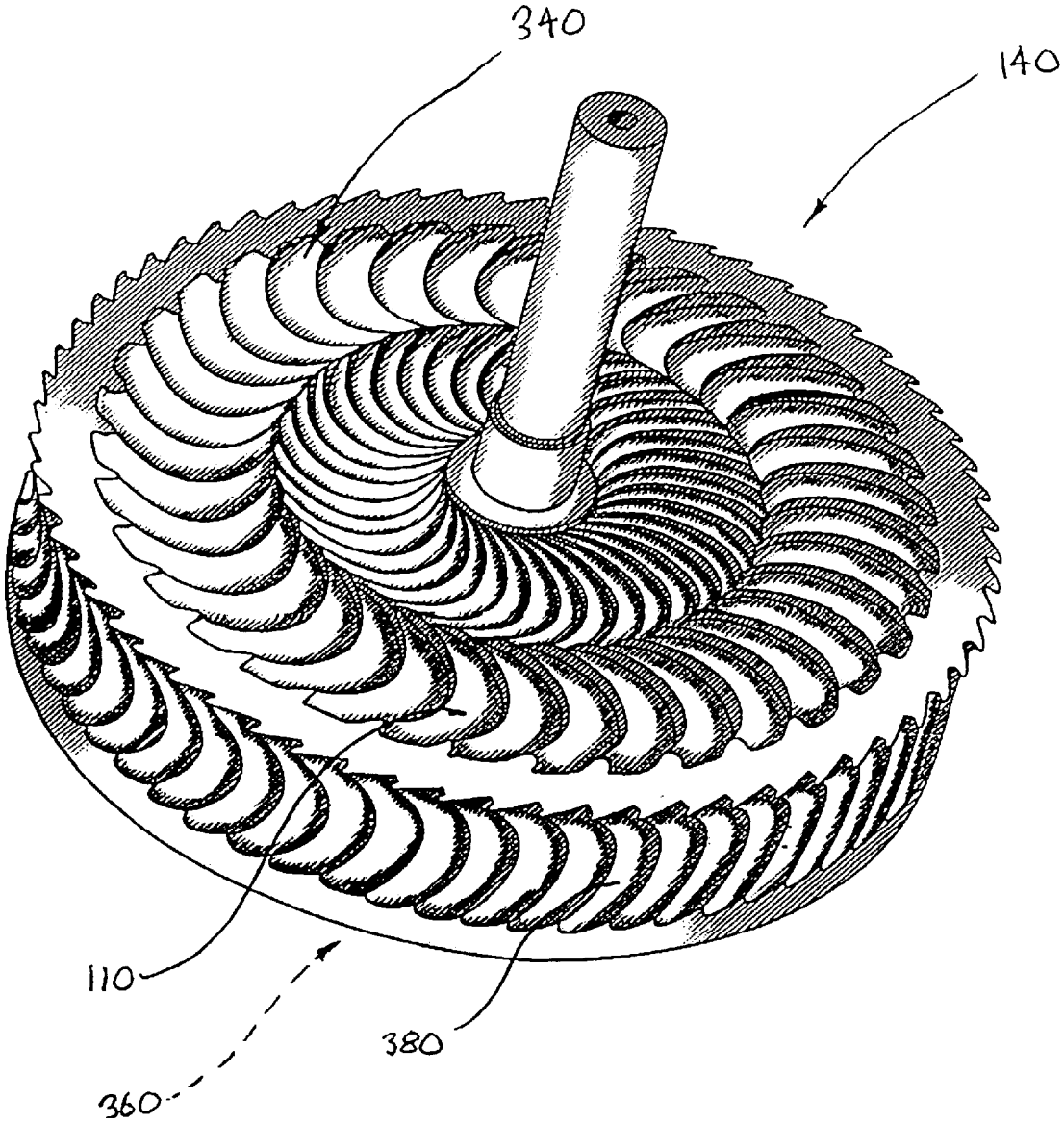
FIG. 9 is a perspective view of an alternative rotor of a turbine engine.
Figure 10:
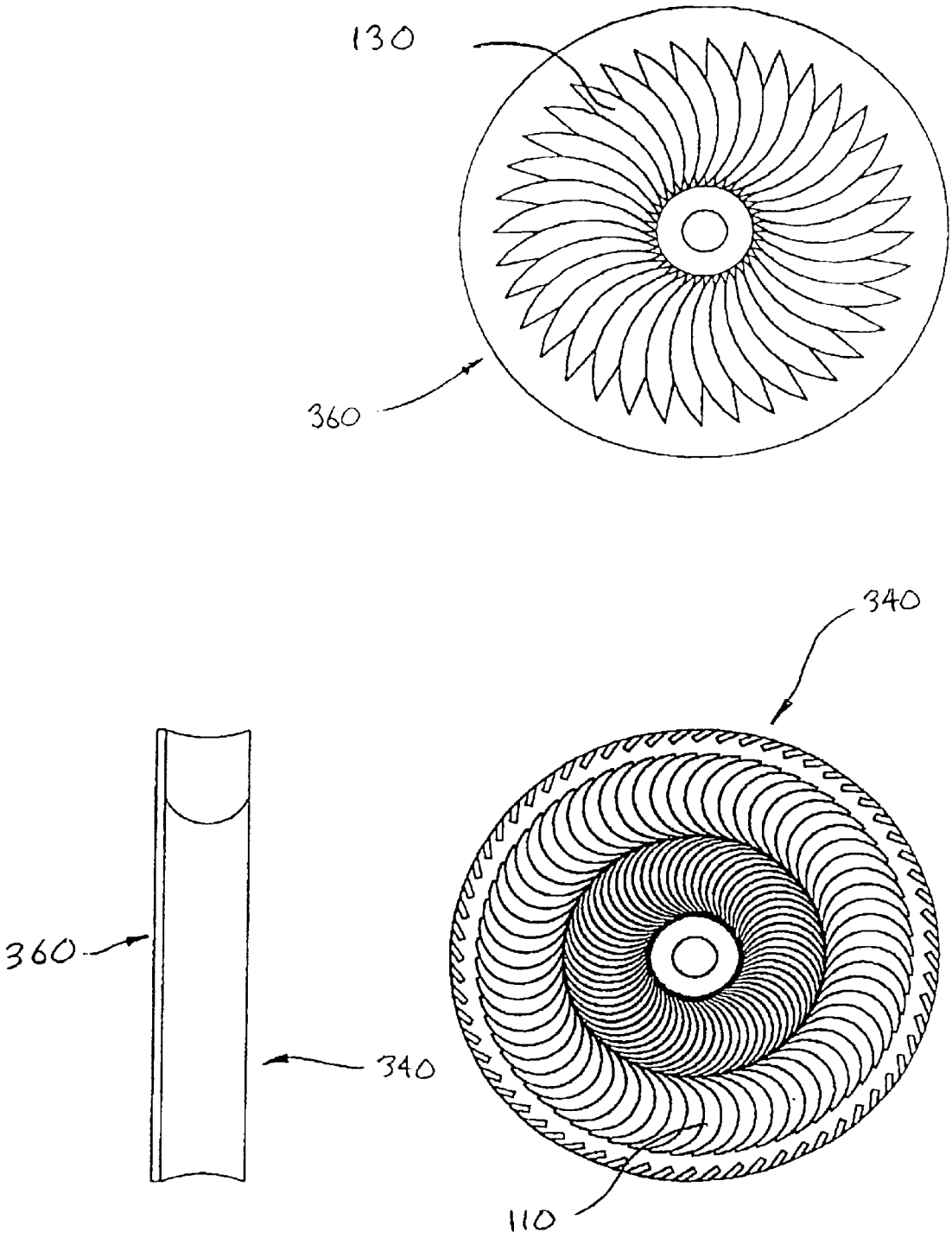
FIG. 10 is elevational views of the alternative rotor of FIG. 9.

FIGS. 9 and 10 illustrate an alternative embodiment of a rotor 140 suited to a turbine engine 100 of the invention. For ease of reference and in order to avoid repetition like components of this and the previous embodiment of the invention have been designated with an additional "0", for example the alternative rotor has been designated as 140. The rotor 140 is formed as a solid disk having the circumferentially spaced and axially directed arcuate ribs 380 formed in its periphery. However, in this alternative embodiment the rotor 140 does not include blades but rather the second and third stages of the turbine are defined by opposing working surfaces 340 and 360 of the rotor 140.

As best shown in FIG. 9, one of the working surfaces is formed as an inner and an outer annulus of additional flutes such as 110. The additional flutes 110 are each arcuate and formed as a series of repeating wave forms with the inner and outer flutes being directed in the same direction as the peripheral flutes such as 380. The opposite surface 360 of the rotor 140 as shown in FIG. 10 defines a third stage of the turbine 100 and includes a single annulus of radially extending flutes such as 130. In this example the housing (not shown) of the turbine includes one or more passageways for porting the working gas from the second to the third stages of the turbine. Otherwise, the working gas is directed tangentially inward of the housing in a similar manner to the preceding turbine 10.

The applicant has conducted preliminary testing in relation to a prototype of the turbine engine of FIG. 1. Initial testing utilising compressed air at approximately 2 Bar and ambient temperature with a volumetric flow rate of around 10 cubic feet per minute (CFM) achieved rotational speeds of up to around 37000 rpm. Further testing utilising LPG at around 2 bar and about 100° C. using hot water as the heat exchange medium provided rotational speeds of around 41000 rpm.

Now that several preferred embodiments of the present invention have been described in some detail it will be apparent to those skilled in the art that the rotor and turbine engine have at least the following advantages:

(i) the turbine engine and rotor are relatively simple in construction with minimum parts;

(ii) the turbine engine achieves relatively high rotational speeds and torques at relatively low working fluid pressures and reduced pressure drop through the turbine;

(iii) the turbine engine is designed to be effectively "powered" by waste heat sources, such as waste heat source 80 depicted schematically in FIG. 1; and (iv) the rotor and turbine engine effectively utilise fluid friction and eddying to create output power.

Those skilled in the art will appreciate that the invention described herein is susceptible to variations and modifications other than those specifically described. For example, the specific construction of the rotor may vary provided it includes three (3) working surfaces which provide three (3) stages for the working fluid in effecting rotation of the rotor. The housing of the turbine engine may also vary from that described although it is important that the housing functions in a complementary manner to the rotor in permitting the three stages of the turbine. All such variations and modifications are to be considered within the scope of the present invention the nature of which is to be determined from the foregoing description.

What is claimed is:

1. A turbine engine comprising a housing within which a rotor is rotatably mounted, said rotor being shaped substantially circular in profile and including three working surfaces generally defined by a peripheral and a pair of adjacent or opposing surfaces, respectively, of the rotor whereby in operation a working fluid introduced into the housing of the engine acts consecutively on the peripheral and thereafter the pair of adjacent or opposing surfaces of the rotor in three respective stages of the turbine to effect rotation of the rotor.

2. A turbine engine as defined in claim 1 and being adapted to operatively couple to an alternator for power generation.

3. A turbine engine as defined in claim 1 and being operatively coupled to a waste heat source which exchanges heat with the working fluid prior to its introduction into the turbine.

4. A turbine engine as defined in claim 1 wherein the peripheral surface of the rotor includes a plurality of circumferentially spaced and generally axially directed ribs.

5. A turbine engine as defined in claim 4 wherein the plurality of ribs are in the form of a series of arcuate flutes each being formed in the periphery of the rotor wherein the working fluid introduced tangentially onto the peripheral surface of the rotor is in a first stage of the turbine directed axially toward one of the pair of opposing side surfaces.

6. A turbine engine as defined in claim 1 wherein the pair of adjacent surfaces of the rotor are generally defined by a plurality of angularly spaced and radially extending rotor blades.

7. A turbine engine as defined in claim 6 wherein the blades are shaped in cross-section and/or angularly oriented relative to an axis of the rotor whereby in operation the working fluid acts on adjacent and/or opposing surfaces of the rotor blades in a second and third stage of the turbine engine.

8. A turbine engine as defined in claim 1 wherein the pair of opposing surfaces of the rotor each include a series of angularly spaced and radially extending other ribs formed on respective opposing faces of the rotor.

9. A turbine engine as defined in claim 8 wherein the other ribs are formed as other flutes in a swirl configuration in the pair of opposing faces of the rotor.

10. A turbine engine as defined in claim 1 wherein the housing is constructed as a split casing.

11. A turbine engine as defined in claim 10 wherein the housing includes a centre casing sandwiched between a pair of outer casings.

12. A turbine engine as defined in claim 11 wherein the rotor is substantially enclosed circumferentially by the centre casing which includes one or more tangentially directed inlets for the working fluid.

13. A turbine engine as defined in claim 11 wherein the pair of outer casings include an inlet outer casing and an outlet outer casing, respectively.

14. A turbine engine as defined in claim 13 wherein the inlet outer casing includes an annular groove being adapted to receive the working fluid from the first stage and redirect said fluid to the second stage.

15. A turbine engine as defined in claim 13 wherein the outlet outer casing includes an annular recess being adapted to receive the working fluid from the second stage and redirect said fluid to the third stage.

16. A turbine engine as defined in claim 15 wherein the annular recess includes a series of further flutes being angularly spaced and directed generally radially inward so as to promote a corresponding "flow" of they working fluid.

17. A turbine engine as defined in claim 13 wherein the housing further includes an exhaust casing mounted to the outlet outer casing and adapted to axially discharge the working fluid from the turbine engine.

18. A turbine engine as defined in claim 17 wherein the exhaust casing includes an exhaust nozzle and internally is shaped in the general form of a conical frustum having its large diameter end disposed adjacent the rotor.

19. A turbine engine as defined in claim 18 wherein the exhaust nozzle includes a baffle plate which is designed to control the pressure of the working fluid at the third stage of the turbine.

20. A rotor of a turbine engine, said rotor being shaped substantially circular in profile and including three working surfaces generally defined by a peripheral and a pair of adjacent or opposing surfaces, respectively, of the rotor whereby in operation a working fluid introduced into the turbine engine acts consecutively on the peripheral and thereafter the pair of adjacent or opposing surfaces of the rotor in three respective stages of the turbine to effect rotation of the rotor.

21. A rotor as defined in claim 20 wherein the peripheral surface of the rotor includes a plurality of circumferentially spaced and generally axially directed ribs.

22. A rotor as defined in claim 21 wherein the plurality of ribs are in the form of a series of arcuate flutes each being formed in the periphery of the rotor wherein the working fluid introduced tangentially onto the peripheral surface of the rotor is in a first stage of the turbine directed axially toward one of the pair of opposing side surfaces.

23. A rotor as defined in claim 20 wherein the pair of adjacent surfaces of the rotor are generally defined by a plurality of angularly spaced and radially extending rotor blades.

24. A rotor as defined in claim 23 wherein the blades are shaped in cross-section and/or angularly oriented relative to an axis of the rotor whereby in operation the working fluid acts on adjacent and/or opposing surfaces of the rotor blades in a second and third stage of the turbine engine.

25. A rotor as defined in claim 20 wherein the pair of opposing surfaces of the rotor each include a series of angularly spaced and radially extending other ribs formed on respective opposing faces of the rotor.

26. A rotor as defined in claim 25 wherein the other ribs are formed as other flutes in a swirl configuration in the pair of opposing faces of the rotor.

* * * * *